US006619651B2

(12) United States Patent
Mäder

(10) Patent No.: US 6,619,651 B2
(45) Date of Patent: Sep. 16, 2003

(54) PROCESS AND APPARATUS FOR FORMING A DOUBLE IMBRICATED FORMATION OF PRINTED PRODUCTS

(75) Inventor: Carl Conrad Mäder, Hittnau (CH)

(73) Assignee: Ferag AG, Hinwil (CH)

( * ) Notice: Subject to any disclaimer, the term of this patent is extended or adjusted under 35 U.S.C. 154(b) by 25 days.

(21) Appl. No.: 09/968,413

(22) Filed: Sep. 26, 2001

(65) Prior Publication Data

US 2002/0038752 A1 Apr. 4, 2002

(30) Foreign Application Priority Data

Oct. 2, 2000 (CH) ..... 1931/00

(51) Int. Cl.[7] ..... B65H 29/06

(52) U.S. Cl. ..... 271/82; 271/69; 271/202; 271/204; 271/216

(58) Field of Search ..... 271/69, 82, 202, 271/204, 270, 151, 216, 237, 233; 270/52.14

(56) References Cited

U.S. PATENT DOCUMENTS

| | | | | |
|---|---|---|---|---|
| 4,434,979 A | * | 3/1984 | Kobler et al. | 271/307 |
| 4,509,703 A | | 4/1985 | Grunder | |
| 4,629,175 A | * | 12/1986 | Fischer et al. | 271/202 |
| 4,696,464 A | | 9/1987 | Gämmerler | |
| 4,736,941 A | * | 4/1988 | Petersen | 271/277 |
| 4,770,407 A | | 9/1988 | Nail | |
| 5,028,045 A | | 7/1991 | Muller | |
| 5,125,645 A | | 6/1992 | Eberle | |
| 5,261,656 A | * | 11/1993 | Gutov et al. | 271/243 |
| 5,295,679 A | | 3/1994 | Reist | |
| 5,715,737 A | | 2/1998 | Stauber et al. | |
| 5,722,216 A | * | 3/1998 | Meier | 53/430 |
| 5,826,476 A | | 10/1998 | Meier | |
| 5,927,712 A | * | 7/1999 | Curley et al. | 271/277 |
| 5,931,459 A | * | 8/1999 | Landgren | 271/204 |

FOREIGN PATENT DOCUMENTS

| | | | | |
|---|---|---|---|---|
| FR | 2 420 499 A | | 10/1979 | |
| WO | WO 9419268 A1 | * | 9/1994 | B65H/29/20 |

* cited by examiner

*Primary Examiner*—Donald P. Walsh
*Assistant Examiner*—M. Kohner
(74) *Attorney, Agent, or Firm*—Alston & Bird LLP

(57) ABSTRACT

A process and an apparatus for forming an imbricated stream of first and second printed products, in which in each case a first and a second printed product are located substantially congruently one upon the other in double imbricated formation. The first and second printed products are individually gripped alternately by an intermediate conveyor and conveyed one behind the other at a conveying spacing d. In each case a first printed product is transferred in a transfer region from the intermediate conveyor to a removal conveyor, which is designed as a belt conveyor, such that the first printed product comes to rest on the belt conveyor and overlaps the preceding printed product in an imbricated manner. A second printed product is then deposited such that it comes to rest substantially congruently on a first printed product which has already been deposited.

22 Claims, 3 Drawing Sheets

PROCESS AND APPARATUS FOR FORMING A DOUBLE IMBRICATED FORMATION OF PRINTED PRODUCTS

BACKGROUND OF THE INVENTION

The invention relates to a process for forming an imbricated stream of first and second printed products, in which in each case a first and a second printed product are located substantially congruently one upon the other (double imbricated formation), and to an apparatus for carrying out the process. The invention also relates to an apparatus for forming and removing an imbricated stream of printed products at optionally a first transfer region or a second transfer region, located downstream of the first transfer region.

Printed products, e.g. newspapers, periodicals, magazines, leaflets and the like, are often conveyed, during production, from one process station to the next in a so-called imbricated arrangement. In an imbricated arrangement, one printed product partially overlaps the printed product which is located beneath, further forward in the conveying direction, with the lateral edges of the printed products, as seen in the conveying direction, terminating essentially flush with one another. In the case of folded printed products, a distinction is made between a forward imbricated arrangement, in which the folded edge of each printed product is located at the front in the conveying direction, and a rearward imbricated arrangement, in which the fold is located at the rear in the conveying direction. The folded edge here may be located at the top or bottom.

Imbricated arrangements are formed, for example, by printed products being individually gripped from a processing drum or from a printed product stack and deposited at regular time intervals on a conveying belt of the removal conveyor, which moves continuously at a predetermined speed. EP-A 0 686 463 and EP-A 0 753 386, and corresponding U.S. Pat. Nos. 5,715,737 and 5,826,476, for example, disclose the operation of individual printing products coming from a processing drum being gripped by grippers arranged at regular intervals on an intermediate conveyor.

For some applications, it is desirable for the printed products not to be conveyed at regular intervals from one another, in which case each printed product just partially overlaps with the one in front and the one behind (single imbricated formation), but to be combined into small groups as a double or multiple imbricated formation. In each case two or more printed products in this case essentially overlap one another, e.g. by being positioned substantially congruently one upon the other. One group, in turn, then only partially overlaps the following group of printed products.

The invention has an object of providing a process and an apparatus for forming an imbricated stream of groups of printed products. The intention, in particular, is to provide a process and an apparatus for forming a double imbricated stream, in which such a group comprises two printed products.

The invention also has the object of further developing a known apparatus for forming an imbricated stream such that it is possible to achieve a higher level of flexibility in respect of the transporting direction and of the type of imbricated formation removed.

SUMMARY OF THE INVENTION

The above and other objects and advantages of the invention are achieved by the provision of a process and apparatus for forming an imbricated stream of first and second printed products in a double imbricated formation, wherein, first and second printed products are individually gripped alternately by an intermediate conveyor and deposited on a conveying belt of the removal conveyor. In each case, a second printed product is fed to the removal conveyor such that it comes to rest substantially congruently, i.e. with maximum overlap, on a first printed product which has already been deposited on the removal conveyor and overlaps the preceding printed product in an imbricated manner. The "first" printed product referred to hereinbelow in each case is the first deposited printed product, which is located at the bottom in a group of printed products. The "second," printed product referred to is that which rests with maximum overlap on the first printed product. First and second printed products may, although not necessarily, be different. They are different, for example, when different sub-products are grouped to produce a main product and are the same when all that is required is further processing of stacks.

As the intermediate conveyor, use is preferably made of a gripper conveyor with grippers arranged one behind the other in the conveying direction. The "first" grippers referred to are the grippers which grip a first printed product, and the "second" grippers are those for accommodating a second printed product. The first and second grippers may be of identical construction. According to the invention, first grippers with first printed products gripped thereby alternate with second grippers with second printed products gripped thereby. If the intention is to form an imbricated formation with more than two printed products per group, then "third", "fourth", etc. printed products are correspondingly positioned on the first and second printed products.

According to the invention, the first and second printed products, which come from a processing drum or from a printed-product stack for example, are individually gripped one behind the other by the intermediate conveyor, which conveys at a conveying speed $V_1$. In this process step, a stream of printed products which are spaced apart from one another approximately by the same conveying spacing d is formed. The grippers of the intermediate conveyer preferably run along a closed circulatory path. In a second process step, in a transfer region, in each case a first printed product is fed, for example with the associated first gripper opening, to a conveying belt of the removal conveyor, which conveys at a conveying speed $V_2$. In a third process step, in each case a second printed product is fed to the conveying belt such that it comes to rest congruently on a first printed product which has already been deposited.

In order for first and second printed products to be positioned congruently one upon the other, either first and second printed products are released at two transfer locations spaced apart from one another in the conveying direction. For this purpose, the spacing $(x_2-x_1)$ between the transfer locations is adapted to the conveying speeds $V_1$, $V_2$ of the intermediate and removal conveyors, the conveying spacing d in the transfer region and the conveying directions relative to one another. $x_1$, $x_2$ are the x coordinates of the first and second transfer locations, respectively, the alignment of the removal conveyor defining the x axis. It is preferably more or less the case that $$D(V_1-V_2)=V_2d,$$

where $V_1$, and $V_2$, with the same conveying directions, have the same signs. With pronounced curvature of the circulatory path of the intermediate conveyor in the transfer region, $V_1$ is the speed component in the conveying direction of the removal conveyor.

As an alternative, all the printed products are transferred at a joint transfer location. In this case, in each case a second printed product is pushed congruently onto a first printed product in each case by means of an additional conveyor, which conveys at least substantially at double the conveying speed $V'=2V_2$ of the second conveyor.

The apparatus according to the invention contains at least one intermediate conveyor with grippers which are moved along a circulatory path and are intended for gripping printed products and supplying the printed products to a transfer region, and a removal conveyor which is designed as a belt conveyor with a conveying belt and is intended for receiving the printed products in the transfer region and removing the printed products, for example, to a further processing station. The apparatus according to the invention also contains at least one initiating means for initiating in each case two successive grippers of the intermediate conveyor in the transfer region, initiation operations taking place at the same transfer location at successive points in time or at spaced apart transfer locations.

An advantage of the invention is that a double or multiple imbricated arrangement can be achieved just by straightforward conversion of known transporting apparatuses. This simplifies the further processing of the products since the printed products do not have to be grouped additionally by means of independent apparatuses.

In a development of the process according to the invention, the printed products are deposited on the conveying belt of the removal conveyor, or on printed products which have already been deposited thereon, from above, the conveying directions either being the same or opposite to one another. In this variant, a forward imbricated arrangement, in which the folds or the gripped edges are located at the front in the conveying direction can be formed by the grippers being pivoted such that the gripped edge is oriented in the conveying direction of the removal conveyor. In order to form a double forward imbricated arrangement, use is preferably made of the process variant of two transfer locations.

In order to produce a rearward imbricated formation, the printed products are preferably transferred at a joint transfer location, the non-gripped, free edge of the printed products then being located at the front in the conveying direction of the removal conveyor.

In order to change over from a forward imbricated formation to a rearward imbricated formation or to change the removal direction, an apparatus for carrying out the process preferably has two removal conveyors. Specific control of the grippers and/or of initiators of the intermediate conveyor makes it possible for printed products to be transferred optionally to the first or to the second removal conveyors. For this purpose, the upstream removal conveyor may be displaced in order to make it easier for printed products to be conveyed onto the further removal conveyor.

The changeover is advantageously made from a double imbricated stream to a single imbricated stream, in which first and second printed products only partially overlap one another, by the grippers assigned to the first and second printed products being opened at a joint transfer location, with the result that first and second printed products come to rest on the conveying belt of the removal conveyor at constant spatial intervals. In the process variant with just one transfer location, in order to change over to a single imbricated stream, the pushing-on operation by means of the additional conveyor is dispensed with. For this purpose, the additional conveyor is deactivated or its conveying speed is reduced to the conveying speed of the removal conveyor. It is thus advantageously possible for a single apparatus, depending on requirements, to produce a single or multiple imbricated stream merely by virtue of the actuation being changed. The apparatus according to the invention thus has a high level of flexibility.

BRIEF DESCRIPTION OF THE DRAWINGS

Exemplary embodiments of the invention are illustrated in the drawings, in which, purely schematically.

DETAILED DESCRIPTION OF THE PREFERRED EMBODIMENTS

Figure 1A:
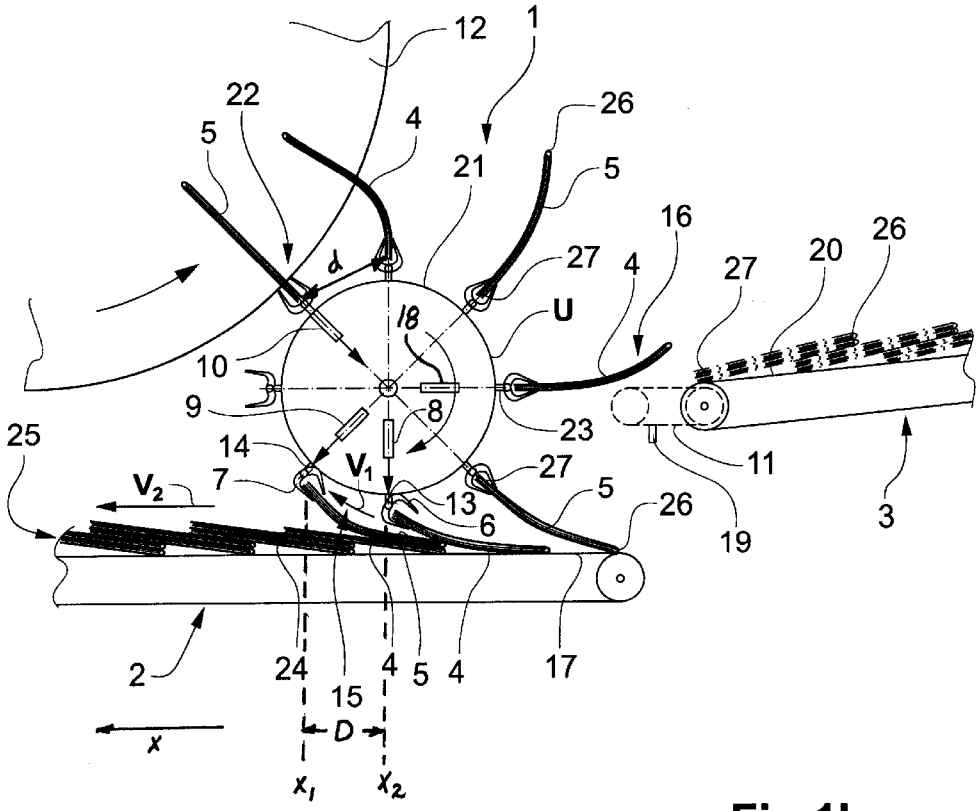
FIGS. 1*a* and 1*b* show, at two different points in time, an apparatus according to the invention for forming a double imbricated formation by releasing a first and a second printed product at a first and a second transfer location, respectively.
Figure 1B:
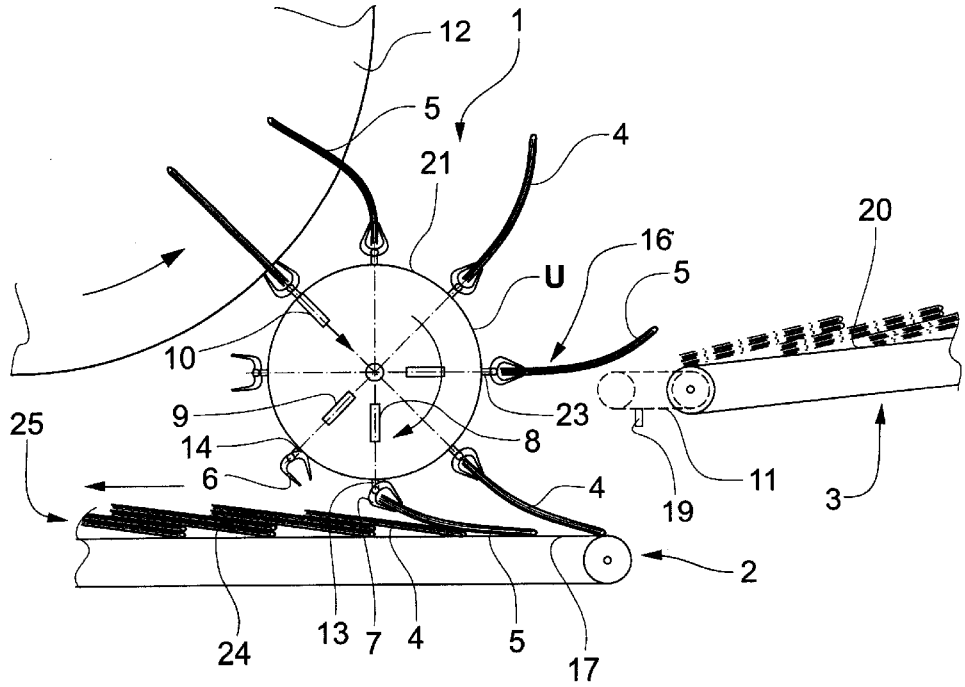

FIGS. 1*a* and 1*b* show an apparatus according to the invention for forming a double imbricated formation at two points in time, to be precise during the operation of simultaneously depositing a first and a second printed product 4 and 5, respectively (FIG. 1*a*), and half a period T later (FIG. 1*b*), where T specifies the time between the operations of depositing two first and two second printed products 4, 5.

The apparatus according to the invention comprises an intermediate conveyor 1 with a plurality of grippers 6, 7 which are arranged on a rotating drum 21 along its circumference. The grippers 6, 7 are opened and closed by initiators 8, 9, 10, 18, arranged in a stationary manner in space, when the gripper runs past the corresponding initiator during rotation of the drum 21. The initiators are, for example, suitably designed guides. By means of a first initiator 10, which is arranged at a receiving location 22, passing grippers 7, 6 are closed and thus grip printed products 4, 5 coming from a processing drum 12. The first initiator 10 may be active at all times in order to close each gripper 6, 7 moved past the receiving location 22. The printed products 4, 5 are then conveyed, by means of the grippers 6, 7, circumferentially along an approximately circular movement path U, predetermined by the shape of the drum 21, to a transfer region 15 in the bottom part of the drum 21. The alignment of the printed products in space can be changed by the grippers being pivoted, e.g. also by means of suitable guides.

Located in the transfer region 15 beneath the drum 21 is a first removal conveyor 2 in the form of a belt conveyor with a conveying belt 17. In the transfer region 15, the first and second printed products 4 and 5, respectively, conveyed by the intermediate conveyor 1 are deposited. In this case, in each case a second printed product 5 is located congruently on a first printed product 4 and forms a stack 24. Adjacent stacks 24 only partially overlap one another, with the result that a double imbricated formation 25 is formed.

For depositing in each case a first printed product 4 on the conveying belt, or partially on the preceding stack 24, there is provided a first depositing initiator 8 which releases passing grippers 6, which contain first printed products 4 ("first" grippers), by opening at a first transfer location 13. The first transfer location 13 is located at the lowest point of the circulatory path U. The first discharging initiator 8 is controlled such that it only opens every second passing gripper 6, 7, i.e. it opens all the first grippers 6 and leaves all the second grippers 7 closed. This can be realized by, for example, pneumatically or electrically controlled movement of the corresponding opening guides into and out of the movement path. This means that only first printed products 4 are deposited at the first transfer location 13.

All the second printed products 5 are drawn on to a second transfer location 14, at which a second discharging initiator 9 is arranged. The latter is set such that it opens at least all the second grippers 7, with the result that second printed products 5 contained therein are deposited at the second transfer location 14. The second discharging initiator 9 may also be permanently active if the intention is to form merely stacks 24 of two printed products. The first discharging initiator 8 is actuated cyclically, with the result that it opens in each case only every second passing gripper. It is also possible, however, for the discharging initiators 8, 9 to be actuated at the same time, in order thus to release printed products 4, 5 simultaneously. The next release then takes place two cycles later.

The conveying speed $V_1$, at which the grippers 6, 7 of the intermediate conveyor 1 circulates, the conveyor speed $V_2$ of the conveying belt 17 of the removal conveyor 2 and the spacing between the first and second transfer locations 13, 14 are coordinated with one another such that in each case a second printed product 5 is positioned as precisely as possible on a first printed product which has already been deposited. It is particularly straightforward if the conveying belt 17 moves at half the conveying speed of the intermediate conveyor. The transfer locations 13, 14 are preferably spaced apart here by a spacing D, which corresponds approximately to the conveying spacing d.

The apparatus shown in FIGS. 1*a*, 1*b* has a second removal conveyor 3 for forming a rearward imbricated formation, in which the free end 26 of a printed product is directed in the conveying direction of the second removal conveyor 3 and the end 27, gripped by the grippers 6, 7, is in the opposite direction. The second removal conveyor 3 is located, in the plane of the circulatory path U of the intermediate conveyor 1, to the side of the intermediate conveyor 1. It can be displaced from the position illustrated into a position in which printed products 4, 5 can be positioned on the conveying belt 20 of the removal conveyor 3 in a further transfer region 16, at a third transfer location 23. For opening grippers 6, 7 at this third transfer location 23, the intermediate conveyor 1 has a third discharging initiator 18, which is arranged halfway up the wheel 21.

Figure 2A:
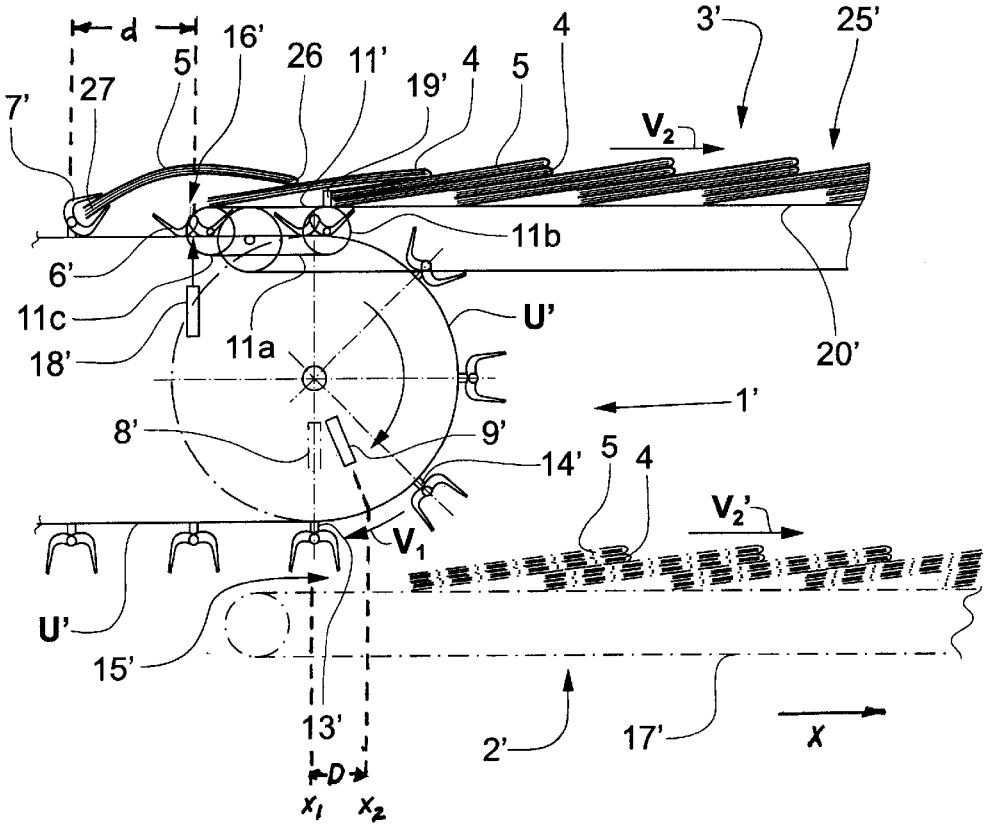
FIGS. 2*a* and 2*b* show, at two different points in time, an apparatus according to the invention for forming a double imbricated formation by releasing first and second printed products at a joint transfer location.
Figure 2B:
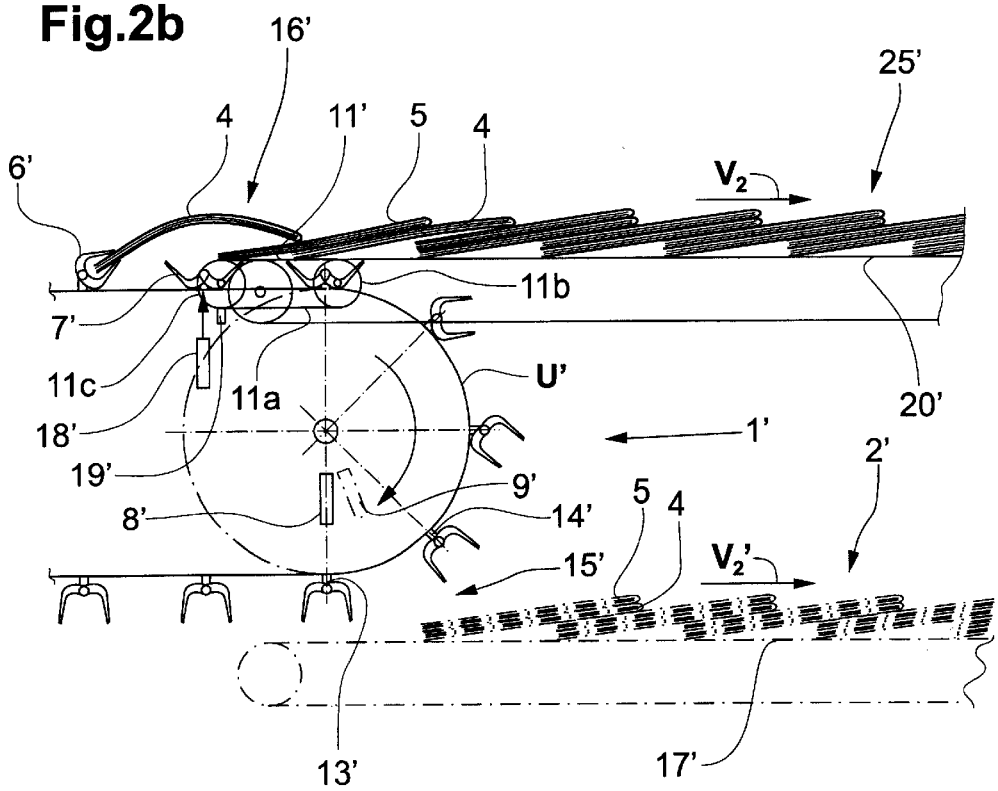

If printed products 4, 5 are to be transferred to the second removal conveyor 3, then the third discharging initiator 18 is activated at all times. For forming a double imbricated formation, the second printed products 5 are pushed congruently onto the first printed products 4, which have already been deposited, by means of an additional conveyor 11, which is illustrated by dashed lines. For this purpose, the additional conveyor 11 has at least one pushing projection 19 which circulates at double the conveying speed of the removal conveyor 3 and carries along every second printed product which arrives and pushes it onto the preceding, first product. Such a removal conveyor is described and shown in more detail in FIGS. 2*a* and 2*b*. The removal conveyor 3 and the third discharging initiator 18 may also be arranged in the upper region of the drum 21, with the conveying belt 20, as is illustrated in FIGS. 2*a* and 2*b*, running tangentially to the movement path of the grippers 6, 7. Alternatively, it is also possible for a removal conveyor with an additional conveyor 11 to be arranged in the bottom region, i.e. beneath the intermediate conveyor 1. For example, the removal conveyor 2 may be equipped with an additional conveyor by means of which first and second printed products which have been deposited at equal time intervals are pushed onto one another to form pairs in each case. In this case, it is possible to dispense with a second discharging initiator 9.

If only a single imbricated formation is to be produced on the second removal conveyor 3, then the additional conveyor 11 may be dispensed with altogether. This is the case, for example, when the apparatus only serves for changing over between different removal directions and/or removal paths or for changing over from a forward imbricated formation to a rearward imbricated formation.

FIGS. 2*a* and 2*b* show a further apparatus according to the invention with an intermediate conveyor 1', a first removal conveyor 2' (illustrated by dashed lines) and a further removal conveyor 3'. The grippers 6', 7' run along a partially circular circulatory path U'. In the upper region of the intermediate conveyor 1', all the grippers 6', 7' are opened as they run past a discharging initiator 18'. The printed products 4, 5 are positioned on a conveying belt 20' of the removal conveyor 3', which runs tangentially to the circulatory path in the transfer region 16'. Every second printed product 5 is pushed, by an additional conveyor 11', onto the first printed product 4 which has been deposited beforehand. For this purpose, the additional conveyor 11' has a circulating pushing projection 19', which projects into the plane of the conveying belt 20' and moves at double the speed of the conveying belt 20'. For example, the additional conveyor 11' may be arranged to the side of the conveying belt 20'. The pushing projection 19' is fastened on a conveying element, for example a belt 11*a*, which runs around two rollers 11*b*, 11*c*. The removal conveyor 3', which is shown in the top part of FIGS. 2*a* and 2*b*, forms a double rearward imbricated formation 25', in which the gripped ends 27 of the printed products are oriented counter to the movement direction of the removal conveyor. The conveying speed $V_2$ of the removal conveyor 3' is approximately half the conveying speed $V_1$, of the intermediate conveyor 1' in the transfer region 16'. The speed of the pushing projection 19' corresponds to the conveying speed $V_1$.

Provided in the bottom part of FIGS. 2*a* and 2*b*, as an alternative or in addition to the removal conveyor 3', is a further removal conveyor 2', which is illustrated by chain-dotted lines. First and second discharging initiators 8', 9' are spaced apart from one another in order to open the first and second grippers 6', 7' at a first and second transfer location 13', 14', respectively. The second discharging initiator 9' is actuated such that it only opens second grippers 7, which pass the second transfer location 14'. The first discharging initiator 8', which is arranged downstream of the second discharging initiator 9' in the direction of circulation, preferably opens all the grippers and thus results in first printed products 4 being discharged at the first transfer location 13'.

The conveying belt 17' of the removal conveyor 2' transports counter to the conveying direction of the intermediate conveyor. As a result, a second printer product 5, released at the second transfer location 14', is positioned on the first printed product 4 which has already been deposited. The conveying speeds $V_1$, $V_2'$ and the spacing D of the discharging initiators 8', 9' are adapted to one another such that in each case two products are positioned as precisely as possible one upon the other. For example, the conveying speed of the removal conveyor $V_2'$ is half the conveying speed $V_1$ of the intermediate conveyor 1', and the spacing between first and second transfer locations 13', 14' is d/2.

Instead of removal conveyor 2' which removes to the right, counter to the conveying direction of the intermediate conveyor, it is also possible to use a removal conveyor which removes in the same direction, as is shown in the bottom part of FIGS. 1*a* and 1*b*. The first and second initiators are then to be arranged correspondingly, with the result that first and second printed products, come to rest directly one upon the other.

If only a single imbricated formation is to be produced by the bottom removal conveyor 2', it is possible to dispense with one of the two initiators 8', 9'.

The initiators, which are only shown schematically in FIGS. 1*a*, 1*b*, 2*a*, 2*b*, are, for example, opening guides which can be introduced into the movement path of the grippers and interact with corresponding elements of the grippers in order to open or to close the grippers. If only every second printed product is to be discharged from a continuous series of printed products, the initiator forming opening guide is periodically introduced into the movement path and removed therefrom in the cyclic manner predetermined by the control unit.

Figure 3A:
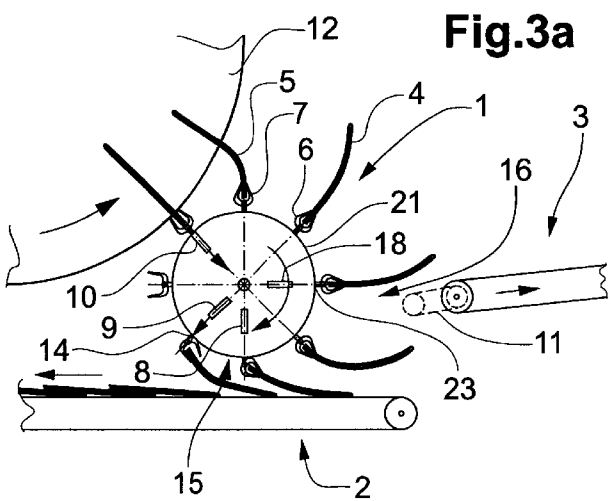
FIG. 3*a* shows the apparatus from FIGS. 1*a* and 1*b* for forming a single rearward imbricated formation.
Figure 3B:
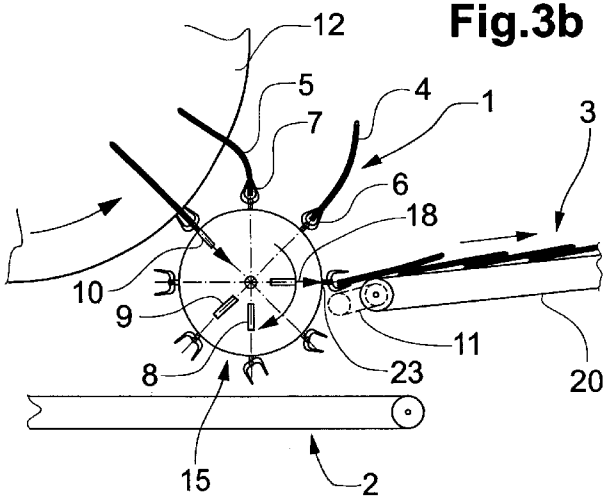
FIG. 3*b* shows the apparatus from FIGS. 1*a* and 1*b* for forming a single forward imbricated formation.

FIGS. 3*a* and 3*b* show the arrangement from FIGS. 1*a* and 1*b* during changeover between a first removal conveyor 2, which removes to the left, and a second removal conveyor 3, which removes to the right. The elements of the apparatus which are illustrated, correspond to those from FIGS. 1*a* and 1*b* and are provided with the same designations. The bottom removal conveyor 2 is operated when the third discharging initiator 18 is deactivated and one or both of the further initiators 8, 9 is/are activated. The first and the second discharging initiators 8, 9 are activated and deactivated in coordination with one another if a double imbrication is to be formed, as is shown in FIGS. 1*a* and 1*b*. For the formation of a single imbrication, as in FIG. 3*a*, it is sufficient for one of the two discharging initiators 8, 9 to be active at all times. In the present case, the first discharging initiator 8 is inactive, with the result that the printed products are only released at the second transfer location 14. It is easy to change over to double imbricated formation by the first discharging initiator 8 being switched on at defined time intervals, in order to release a second printed product at the same time as a first printed product in the second transfer location 14. In FIG. 3*a*, the second removal conveyor 3 is located in a rest position, in which it does not obstruct the movement of the printed products 4, 5 in the intermediate conveyor 1.

In FIG. 3*b*, the second removal conveyor 3 is active and has been moved up to the intermediate conveyor 1. By means of the third discharging initiator 18, which is active at all times, each gripper 6, 7 which passes the associated transfer region 23 is opened and deposits a printed product 4, 5 on the removal conveyor 3. A single imbrication is formed by the additional conveyor 11 being inactive, as is illustrated here. If the intention is to change over to a double imbrication formation, the additional conveyor 11 is activated and thus pushes in each case two printed products 4, 5 one upon the other. If basically no double imbrication is to be formed, it is also possible to dispense with the intermediate conveyor.

Figure 4A:
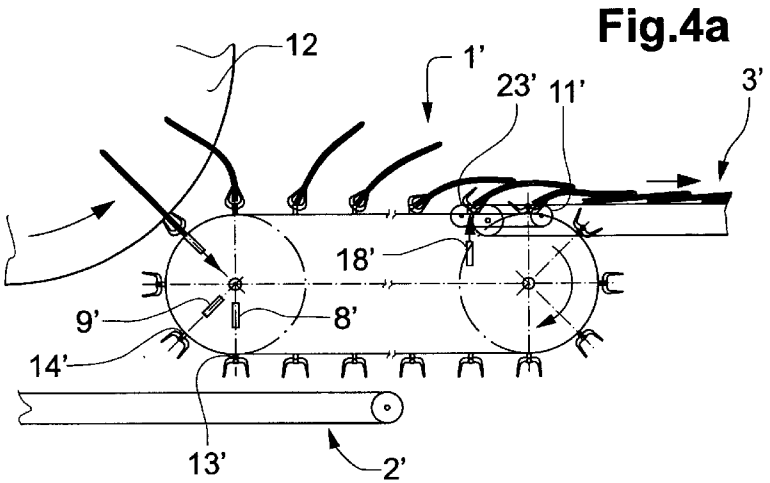
FIG. 4*a* shows the apparatus from FIGS. 2*a* and 2*b* for forming a single rearward imbricated formation.
Figure 4B:
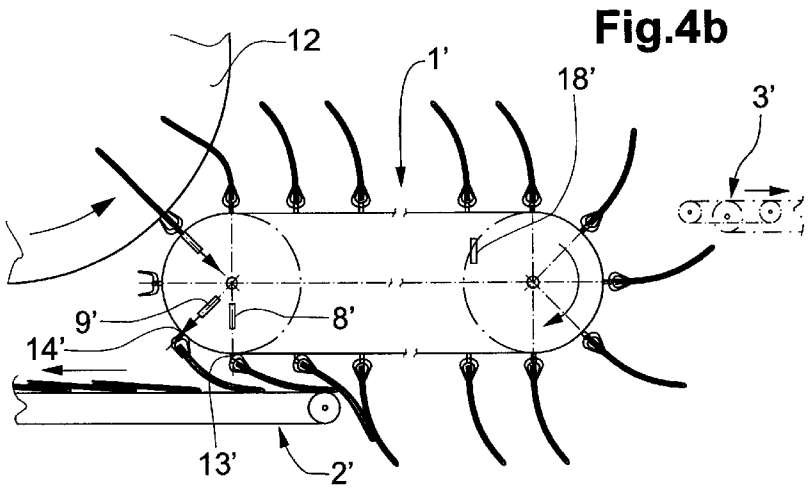
FIG. 4*b* shows the apparatus from FIGS. 2*a* and 2*b* for forming a single forward imbricated formation.

FIGS. 4*a* and 4*b* show the changeover between removal by a first removal conveyor 2' and a second removal conveyor 3' to the left and right with the arrangement from FIGS. 2*a* and 2*b*. By activation of the third dispensing initiator 18', the printed products are positioned on the conveying belt of the removal conveyor 3' at a third transfer location 23', see FIG. 4*a*. A double imbricated formation is formed by the additional conveyor 11' being activated. A single imbricated formation, with the additional conveyor 11' inactive, is illustrated here. If only single imbricated formations are to be formed, it is also possible to dispense with the additional conveyor 11'. For removal via the bottom removal conveyor 2', the discharging initiator 18' is deactivated and one or both of the discharging initiators 8', 9' is/are activated. Printed products are thus positioned on the conveying belt of the removal conveyor 2' at the first and/or the second transfer locations 13', 14'. In the case illustrated in FIG. 4*b*, only the second discharging initiator 9' is active, with the result that a single imbricated formation is formed.

What is claimed is:

1. A process for forming an imbricated stream of first and second printed products, in which in each case a first and a second printed product are located substantially congruently one upon the other to form a stack, comprising the steps of:

individually gripping alternately first and second printed products by an intermediate conveyor which conveys at a conveying speed $V_1$ and conveys the first and second printed products in a stream direction one behind the other at a conveying spacing d;

transferring in each case a first printed product in a transfer region from the intermediate conveyor to a removal conveyor, which conveys at a conveying speed $V_2$, such that the first printed product is deposited on the removal conveyer such that it overlaps a preceding printed product in an imbricated manner; and transferring in each case a second printed product in the transfer region such that it is deposited substantially congruently on the first printed product which has already been deposited and forms a stack composed of at least the first and second printed products.

2. The process as claimed in claim 1, wherein the direction of the removal conveyor defines an x axis, and wherein, in the transfer region, the first printed products are released at a first transfer location having an x coordinate $x_1$, and the second printed products are released at a second transfer location, spaced apart from the first, having an x coordinate $x_2$, and are thereby transferred to the removal conveyor, the spacing $D=(x_2-x_1)$ between the first and second transfer locations being adapted to the conveying speeds $V_1$, $V_2$ and the conveying spacing d.

3. The process as claimed in claim 2, wherein $$(x_2-x_1)\cdot(V_1-V_2)=V_2d.$$

4. The process as claimed in claim 2, wherein the conveying speed $V_1$ is at least approximately double the conveying speed $V_2$, and the intermediate conveyor and removal conveyor convey approximately in the same direction in the transfer region, and in that the spacing D between the first and second transfer locations corresponds at least approximately to the conveying spacing d, and the second transfer location being located downstream of the first transfer location.

5. The process as claimed in claim 2, wherein the magnitudes of the conveying speed $V_1$ and the conveying speed $V_2$ are at least approximately equal, the intermediate conveyor and removal conveyor convey in opposite directions in the transfer region, and the second transfer location is located at least approximately at a spacing d/2 upstream of the first transfer location.

6. The process as claimed in claim 1, wherein, in the transfer region, first and second printed products are fed to the removal conveyor at a joint transfer location x, in each case a second printed product being pushed onto a first printed product by means of an additional conveyor which conveys at least approximately at double the conveying speed $V'=2V_2$ of the second conveyor.

7. The process as claimed in claim 1, wherein a changeover is made from a double imbricated formation to a single imbricated formation in which the first and second printed products only partially overlap one another by transferring the first and second printed products at a joint transfer location.

8. The process as claimed in claim 6, wherein a changeover is made from a double imbricated formation to a single imbricated formation in which first and second printed products only partially overlap one another by the additional conveyor being deactivated or its conveying speed being reduced to $V'=V_2$.

9. An apparatus for forming printed products in stacks which are arranged in an imbricated stream, comprising an intermediate conveyor with grippers which are arranged one behind the other so as to be moved along a circulatory path and for gripping printed products and supplying the printed products to a transfer region;

a removal conveyor for receiving the printed products in the transfer region and for removing the printed products; and initiating means for initiating in each case at least two successive grippers of the intermediate conveyor in the transfer region so that the products are formed into stacks composed of at least two products which overlie each other substantially congruently and with the stacks arranged in an imbricated stream.

10. The apparatus as claimed in claim 9, wherein the initiating means comprises at least a first and a second initiator, with the first initiator being capable of opening a gripper passing a first transfer location and the second initiator being capable of opening a gripper passing a second transfer location which is spaced apart from the first transfer location in the conveying direction, the spacing $D=(x_2-x_1)$ between the first and second transfer locations being adapted to the conveying speeds $V_1$, $V_2$ and the conveying spacing d, wherein $V_1$ is the conveying speed of the intermediate conveyor, $V_2$ is the conveying speed of the removal conveyor, and the conveying spacing d is the spacing between adjacent grippers of the intermediate conveyor.

11. The apparatus as claimed in claim 10, further comprising a control unit which can actuate at least one of the initiators for the periodic activation and deactivation thereof.

12. The apparatus as claimed in claim 9, wherein the removal conveyor in the transfer region runs in the horizontal direction in a bottom region of the intermediate conveyor and spaced therefrom with the result that the printed products can be deposited from above, with the removal conveyor and the intermediate conveyor conveying in the same direction or opposite directions in the transfer region.

13. The apparatus as claimed in claim 9, wherein the initiating means comprises at least one initiator which is capable of opening grippers passing a common transfer location, and an additional conveyor which is arranged upstream of the removal conveyor and conveys at double the conveying speed $V'=2V_2$ of the removal conveyor, for pushing in each case a second printed product substantially congruently onto a first printed product already located on the removal conveyor.

14. The apparatus as claimed in claim 13, wherein the additional conveyor has at least one pushing projection circulating at $V'=2V_2$, the time interval at which the one pushing projection circulates corresponding to the time interval between in each case two second printed products.

15. The apparatus as claimed in claim 10 further comprising a further removal conveyor running in the horizontal direction and capable of receiving printed products in a further transfer region.

16. The apparatus as claimed in claim 15, wherein the initiating means further comprises at least one further initiator, which is capable of opening in each case the grippers passing a third transfer location in the further transfer region.

17. The apparatus as claimed in claim 16, wherein the further removal conveyor can be displaced between a first position in which it is capable of receiving printed products from the intermediate conveyor, and a second withdrawn position in which the printed products can be conveyed from the intermediate conveyor to said first mentioned removal conveyor and can be received by the latter.

18. The apparatus as claimed in claim 9, wherein the circulatory path of the intermediate conveyor is arcuate at least in the transfer region.

19. An apparatus for forming and removing an imbricated stream of printed products at optionally a first transfer region or a second transfer region located downstream of the first transfer region, comprising an intermediate conveyor with grippers which are arranged one behind the other so as to be moved along a circulatory path and for gripping printed products and supplying the printed products to the first and second transfer regions;

a first removal conveyor for receiving the printed products in the first transfer region;

a second removal conveyor for receiving the printed products in the second transfer region;

initiating means comprising at least a first initiator, which is capable of opening in each case a gripper passing a transfer location in the first transfer region, and a further initiator which is capable of opening in each case a gripper passing a transfer location in the second transfer region;

a control unit for selectively activating said first initiator if transfer to the first removal conveyor is to take place, and deactivating the same if transfer to the second removal conveyor is to take place, and wherein at least one of the transfer regions is assigned two initiators which, in the relevant transfer region, are capable of opening a gripper passing a first transfer location $x_1$ and a second transfer location $x_2$ respectively, with the second transfer location being spaced apart from the first transfer location in the conveying direction, the spacing $D=(x_2-x_1)$ between the first and second transfer locations being adapted to the conveying speeds $V_1$, $V_2$ of the intermediate conveyor and of the relevant removal conveyor, respectively, and the conveying spacing d between two printed products in the intermediate conveyor.

20. An apparatus for forming printed products in stacks which are arranged in an imbricated stream, comprising an intermediate conveyor with grippers which are arranged one behind the other so as to be moved along a circulatory path and for gripping printed products and supplying the printed products to a transfer region;

a removal conveyor for receiving the printed products in the transfer region and for removing the printed products;

means for transferring a first printed product in the transfer region from the intermediate conveyor to the removal conveyor, such that the first printed product is deposited on the removal conveyor and overlaps a preceding printed product in an imbricated manner; and means for transferring a second printed product in the transfer region from the intermediate conveyor to the removal conveyor such that it rests with maximum overlap on the first printed product which has already been deposited and forms a stack composed of at least the first and second printed products.

21. An apparatus for forming and removing an imbricated stream of printed products at optionally a first transfer region or a second transfer region located downstream of the first transfer region, comprising an intermediate conveyor with grippers which are arranged one behind the other so as to be moved along a circulatory path and for gripping printed products and supplying the printed products to the first and second transfer regions;

a first removal conveyor for receiving the printed products in the first transfer region;

a second removal conveyor for receiving the printed products in the second transfer region;

initiating means comprising at least a first initiator, which is capable of opening in each case a gripper passing a transfer location in the first transfer region, and a further initiator which is capable of opening in each case a gripper passing a transfer location in the second transfer region; and a control unit for selectively activating said first initiator if transfer to the first removal conveyor is to take place, and deactivating the same if transfer to the second removal conveyor is to take place, and wherein at least the first removal conveyor can be displaced between a first position in which it is capable of receiving the printed products from the intermediate conveyor, and a second withdrawn position in which the printed products can be conveyed from the intermediate conveyor to the second removal conveyor and can be received by the same.

22. An apparatus for forming and removing an imbricated stream of printed products at optionally a first transfer region or a second transfer region located downstream of the first transfer region, comprising an intermediate conveyor with grippers which are arranged one behind the other so as to be moved along a circulatory path and for gripping printed products and supplying the printed products to the first and second transfer regions;

a first removal conveyor for receiving the printed products in the first transfer region;

a second removal conveyor for receiving the printed products in the second transfer region;

initiating means comprising at least a first initiator, which is capable of opening in each case a gripper passing a transfer location in the first transfer region, and a further initiator which is capable of opening in each case a gripper passing a transfer location in the second transfer region; and a control unit for selectively activating said first initiator if transfer to the first removal conveyor is to take place, and deactivating the same if transfer to the second removal conveyor is to take place, and wherein at least one of the removal conveyors comprises an additional conveyor which is arranged at the upstream end thereof and conveys at double the conveying speed $V'=2V_2$ of the one removal conveyor, for putting in each case a second printed product substantially congruently onto in each case a first printed product already located on the one removal conveyor.

* * * * *